US008556262B2

(12) United States Patent
Shigeta

(10) Patent No.: US 8,556,262 B2
(45) **Date of Patent: *Oct. 15, 2013**

(54) TABLE GAME SYSTEM

(75) Inventor: Yasushi Shigeta, Kyoto (JP)

(73) Assignee: Angel Playing Cards Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/825,261

(22) Filed: Jun. 28, 2010

(65) Prior Publication Data

US 2011/0034243 A1 Feb. 10, 2011

Related U.S. Application Data

(63) Continuation of application No. 12/535,473, filed on Aug. 4, 2009, now Pat. No. 7,762,889, which is a continuation-in-part of application No. 11/884,021, filed as application No. PCT/JP2005/003789 on Mar. 4, 2005, said application No. 12/535,473 is a continuation-in-part of application No. 10/543,073, filed as application No. PCT/JP03/16879 on Dec. 26, 2003, now abandoned.

(30) Foreign Application Priority Data

Jan. 14, 2003 (JP) ..... 2003-5319
Mar. 19, 2004 (JP) ..... 2004-079519

(51) Int. Cl.
*A63F 1/12* (2006.01)

(52) U.S. Cl.
USPC ..... 273/149 R; 463/29

(58) Field of Classification Search
USPC ..... 463/29; 273/149 R
See application file for complete search history.

(56) References Cited

U.S. PATENT DOCUMENTS 4,513,696 A 4/1985 Fujii
4,513,969 A * 4/1985 Samsel, Jr. ..... 273/149 R (Continued)

FOREIGN PATENT DOCUMENTS

JP H5-398 1/1993
JP H5-20512 1/1993

(Continued)

OTHER PUBLICATIONS

Non-Final Office Action dated Dec. 8, 2010 issued to U.S. Appl. No. 11/884,021.

(Continued)

*Primary Examiner* — Tramar Harper
(74) *Attorney, Agent, or Firm* — Amster, Rothstein & Ebenstein LLP

(57) ABSTRACT

A table game system comprises a plurality of playing cards and a card shooter apparatus. The cards include an ultraviolet-ray reaction code comprising at least two sets of code elements that are arranged along one side of a face of the card. The code represents at least the number of a card. The card shooter apparatus includes a card housing for containing the cards, a card guide unit that guides cards pulled out one by one from the card housing, one or more card detecting sensors that detect the existence or non-existence of a card pulled out along a card guiding direction of the card guide unit, and one or more black light sensors that read the ultraviolet-ray reaction code from the card guided by the card guide unit.

19 Claims, 14 Drawing Sheets

(56) References Cited

U.S. PATENT DOCUMENTS

| | | | | | |
|---|---|---|---|---|---|
| 4,534,562 | A | | 8/1985 | Cuff | |
| 4,586,712 | A | | 5/1986 | Lorber et al. | |
| 4,794,239 | A | | 12/1988 | Allais | |
| 5,067,713 | A | | 11/1991 | Soules et al. | |
| 5,166,502 | A | | 11/1992 | Rendleman et al. | |
| 5,169,155 | A | * | 12/1992 | Soules et al. | 273/293 |
| 5,259,907 | A | | 11/1993 | Soules et al. | |
| 5,331,141 | A | | 7/1994 | Kaneko | |
| 5,374,061 | A | | 12/1994 | Albrecht | |
| 5,669,816 | A | | 9/1997 | Garczynski | |
| 5,707,287 | A | * | 1/1998 | McCrea, Jr. | 463/27 |
| 5,722,893 | A | | 3/1998 | Hill et al. | |
| 5,779,546 | A | | 7/1998 | Meissner | |
| 5,814,804 | A | | 9/1998 | Kostizak | |
| 5,911,626 | A | | 6/1999 | McCrea, Jr. | |
| 5,941,769 | A | * | 8/1999 | Order | 463/12 |
| 6,039,650 | A | * | 3/2000 | Hill | 463/47 |
| 6,042,150 | A | | 3/2000 | Daley | |
| 6,066,857 | A | | 5/2000 | Fantone et al. | |
| 6,093,103 | A | | 7/2000 | McCrea, Jr. | |
| 6,098,892 | A | | 8/2000 | Peoples, Jr. | |
| 6,126,166 | A | | 10/2000 | Lorson | |
| 6,217,447 | B1 | | 4/2001 | Lofink et al. | |
| 6,270,406 | B1 | | 8/2001 | Sultan | |
| 6,460,848 | B1 | | 10/2002 | Soltys et al. | |
| 6,527,191 | B1 | * | 3/2003 | Jannersten | 235/487 |
| 6,582,301 | B2 | | 6/2003 | Hill | |
| 6,588,751 | B1 | | 7/2003 | Grauzer et al. | |
| 6,629,894 | B1 | * | 10/2003 | Purton | 463/47 |
| 6,638,161 | B2 | | 10/2003 | Soltys et al. | |
| 7,029,009 | B2 | | 4/2006 | Grauzer et al. | |
| 7,093,130 | B1 | | 8/2006 | Kobayashi et al. | |
| 7,172,507 | B2 | | 2/2007 | Fujimoto | |
| 7,222,852 | B2 | | 5/2007 | Soltys et al. | |
| 2002/0068635 | A1 | | 6/2002 | Hill | |
| 2002/0155869 | A1 | | 10/2002 | Soltys et al. | |
| 2002/0163125 | A1 | * | 11/2002 | Grauzer et al. | 273/149 R |
| 2002/0165029 | A1 | * | 11/2002 | Soltys et al. | 463/47 |
| 2003/0171142 | A1 | | 9/2003 | Kaji et al. | |
| 2003/0176209 | A1 | | 9/2003 | Soltys et al. | |
| 2003/0195025 | A1 | | 10/2003 | Hill | |
| 2004/0026636 | A1 | * | 2/2004 | Shigeta | 250/556 |
| 2004/0100026 | A1 | * | 5/2004 | Haggard | 273/304 |
| 2005/0121852 | A1 | | 6/2005 | Soltys et al. | |
| 2005/0137005 | A1 | | 6/2005 | Soltys et al. | |

FOREIGN PATENT DOCUMENTS

| | | | | |
|---|---|---|---|---|
| JP | 9-215812 | | | 8/1997 |
| JP | 2001222687 | | | 8/2001 |
| JP | 2002165916 | | | 6/2002 |
| JP | 2002224443 | | | 8/2002 |
| JP | 2002224443 | A | * | 8/2002 |
| JP | 2003052902 | | | 2/2003 |
| JP | 2003070956 | | | 3/2003 |
| JP | 2003144742 | | | 5/2003 |
| JP | 2003250950 | | | 9/2003 |
| JP | 2005198668 | | | 7/2005 |
| JP | 2005267625 | | | 9/2005 |
| JP | 2005296634 | | | 10/2005 |
| JP | 2007236995 | | | 9/2007 |
| JP | 2008188471 | | | 8/2008 |
| WO | 9614115 | | | 5/1996 |
| WO | 0156670 | | | 8/2001 |
| WO | 02064225 | | | 8/2002 |
| WO | WO 02064225 | A1 | * | 8/2002 |
| WO | 03026763 | | | 4/2003 |

OTHER PUBLICATIONS

Final Office Action dated Dec. 8, 2010 issued to U.S. Appl. No. 12/231,657.

Final Office Action dated Apr. 14, 2010 issued to U.S. Appl. No. 10/542,073.

Non-Final Office Action dated Oct. 1, 2010 issued to U.S. Appl. No. 11/929,727.

Non-Final Office Action dated Mar. 19, 2010 issued to U.S. Appl. No. 12/231,657.

* cited by examiner

TABLE GAME SYSTEM

CROSS-REFERENCE TO RELATED APPLICATIONS

This application is a continuation application of U.S. application Ser. No. 12/535,473, filed Aug. 4, 2009, now U.S. Pat. No. 7,762,889 which is a continuation-in-part of U.S. application Ser. No. 11/884,021, filed Aug. 9, 2007, which is a U.S. national phase application claiming priority under 35 U.S.C. §371 to International Application No. PCT/JP2005/003789, filed Mar. 4, 2005, which claims priority under 35 U.S.C. §119 to Japanese Patent Application No. 2004-079519, filed Mar. 19, 2004, the contents of all of which are incorporated herein by reference. This application is a continuation application of U.S. application Ser. No. 12/535,473, filed Aug. 4, 2009, which is a continuation-in-part of U.S. application Ser. No. 10/542,073, filed Mar. 13, 2006, now abandoned which is a U.S. national phase application based on International Patent Application No. PCT/JP2003/016879, filed Dec. 26, 2003, which claims priority to Japanese Patent Application No. 2003-5319, filed Jan. 14, 2003, the contents of all if which is incorporated herein by reference.

FIELD OF THE INVENTION

The present invention relates to a table game system including a card shooter apparatus that is used suitably for a card game in which playing cards (trump cards; hereinafter simply referred to as cards) are to be used.

BACKGROUND OF THE INVENTION

Conventionally, a card reader that is used suitably for a card game in a casino, etc. is suggested. For example, PCT Japanese Translation Patent Publication No. 10-508236 (Page 12, FIG. 1) discloses a card reader equipped with a card shooter. In the apparatus of this literature, a CCD image sensor and related optical system components are built in the card shooter. Further, an outlet of the card shooter is provided with a card reading window. Also, when a card passes through the shooter outlet, the card is read through the reading window.

However, in the conventional apparatus, reading precision is restricted by the CCD image sensor and related optical system components. The reading precision is desired to improve as much as possible. This point is also important in reducing the influence on a game progress caused by generation of a read error.

Further, in the conventional apparatus, in order to secure reading capability, the speed of a card when a card is pulled out of the card shooter needs to be comparatively low, for example, the maximum speed is about 1 m/s. On the other hand, even if the card speed is larger, a card needs to be read accurately. This point is also important in the game progress of a casino, etc.

The invention has been made in view of the above problems. It is therefore an object of the invention to provide a card reader that is capable of utilizing an existing card shooter, is high in reading precision, and is high in the threshold value of the card speed at the time of reading.

SUMMARY OF THE INVENTION

One aspect of the present invention is a table game system comprising a plurality of playing cards and a card shooter apparatus. Each card includes an ultraviolet-ray reaction code comprising at least two sets of code elements arranged along one side of a face of the card. The code represents at least the number of a card. The card shooter apparatus comprises a card housing for containing the cards, a card guide unit that guides cards pulled out one by one from the card housing, one or more card detecting sensors that detect the existence or non-existence of each card pulled out along a card guiding direction of the card guide unit, and one or more black light sensors that read the ultraviolet-ray reaction code from each card guided by the card guide unit.

As described hereafter, other aspects of the invention exist. Thus, this summary of the invention is intended to provide a few aspects of the invention and is not intended to limit the scope of the invention described and claimed herein.

DETAILED DESCRIPTION OF THE EXEMPLARY EMBODIMENTS

Figure 1:
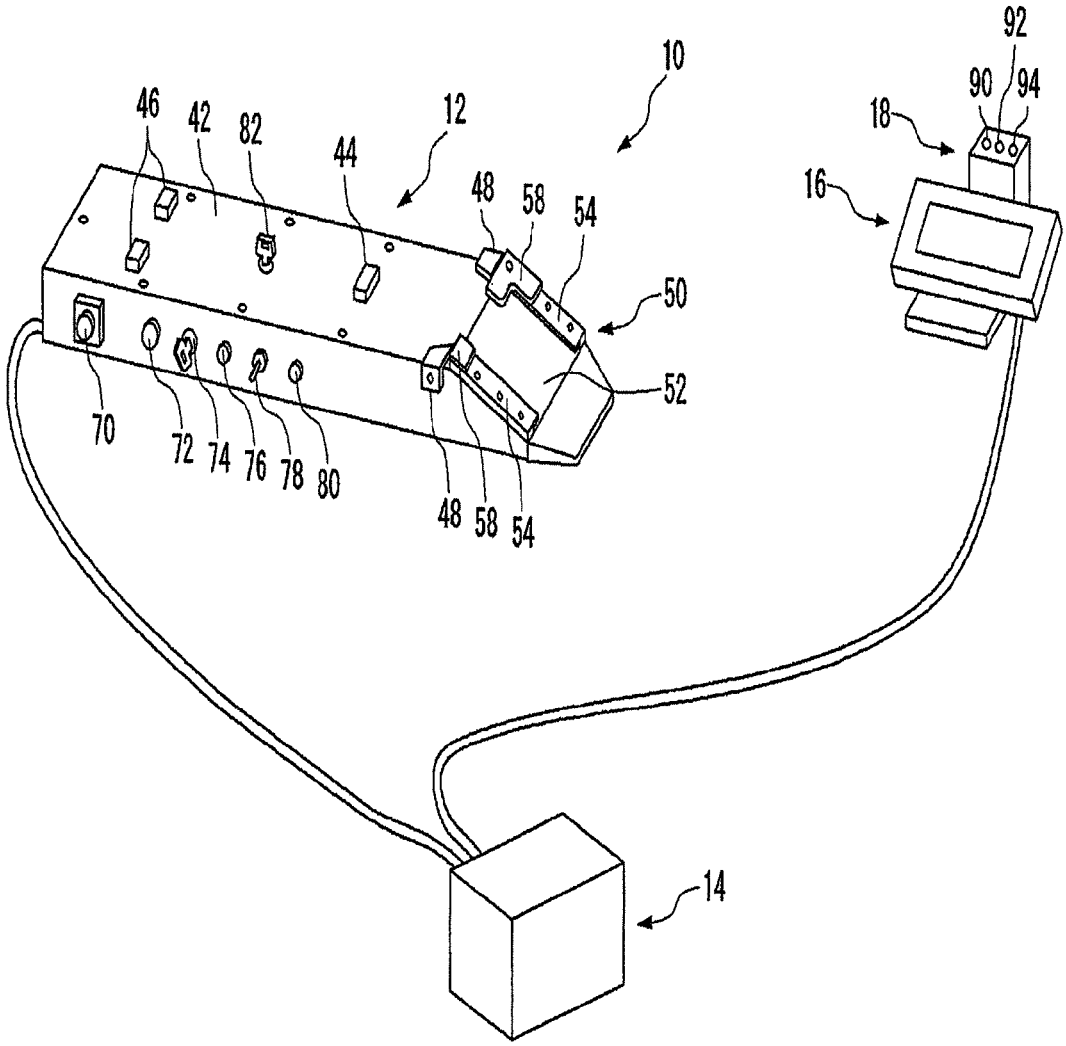
FIG. 1 is a view showing the overall configuration of a card reader of the present embodiment.

The following detailed description refers to the accompanying drawings. The following detailed description and the accompanying drawings do not limit the invention. Instead, the scope of the invention is defined by the appended claims.

A card reader includes a platform that is set on a game table and has a card shooter mounted thereon; a card guide unit that is provided in the platform to guide cards, which are pulled out one by one from the card shooter, onto the game table; and black light sensors that are provided in the card guide unit to read an ultraviolet-ray reaction code including the number of a card from the card.

According to this card reader, the platform is provided between the game table and the card shooter, and the platform is provided with a card reading function. Thus, reading of a card is enabled while the existing card shooter is utilized. Moreover, since the black light sensors are used, reading precision is high, and the threshold value of the card speed at the time of reading can also be set to a large value, for example, about 3.6 m/s. Also, the reading result of a card is suitably helpful to prevention of an illegal act.

Preferably, the card guide unit has a card guide surface, card guide rails are provided at edges of the card guide surface, a card passage gap is formed between the card guide surface and the card guide rails, and the black light sensors are provided so as to read a card from the card guide surface within the card passage gap. Accordingly, the influence of outside light in a card reading part can be reduced, and reading precision can be improved.

Preferably, the card reader further includes a win/lose determining means that determines the win or lose of a card game on the basis of the numbers of the cards that are sequentially read by the black light sensors, and an output means that outputs a game result determined by the win/lose determining means. Accordingly, the progress of a game can be supported, and an illegal act can be prevented.

Preferably, the card reader further includes an invalid mode setting means that sets a first card invalid mode that invalidates a card that is first pulled out in each game. Accordingly, even when a rule that invalidates a first card is adopted, the card reader can perform game result determination processing adapted to a card game, and can smoothly process a card game.

Preferably, the card reader further includes first and second card detecting sensors that are arranged along a guiding direction of the card guide unit to detect the existence or non-existence of a card, and a measurement validity/invalidity determining means that determines whether or not a card has normally passed along the card guide unit, on the basis of detection signals of the first and second card detecting sensors.

Preferably, the measurement validity/invalidity determining means validates reading of a card when the first card detecting sensor and the second card detecting sensor detect the card in order, and then the first card detecting sensor and the second card detecting sensor stop detecting the card in order.

Preferably, the measurement validity/invalidity determining means invalidates reading of a card when the first card detecting sensor and the second card detecting sensor detect the card in order, and then the second card detecting sensor and the first card detecting sensor stop detecting the card in order. Accordingly, when a card slips back, it is possible to suitably cope with this.

Preferably, in the card reader, the sensitivity of the second card detecting sensor is set so as to detect a card for game and so as not to detect a cut card. Accordingly, when a cut card is used, the card reader can suitably cope with this.

Further, in the card reader, the black light sensors are adapted to detect code elements including a given number from a card which the code elements are arrayed in a card pulling direction as an ultraviolet-ray reaction code, and to output a detection signal. Also, the card reader includes a number specifying means, and the number specifying means specifies a card associated with the numbers of the code elements on the basis of the detection signals of the black light sensors. The code elements are typically marks printed with ultraviolet-ray reaction ink. The code elements may be spaced apart from an edge of the card in a direction across a card pulling direction.

The numbers of the code elements are associated with at least the number of a card. The numbers of the code elements may be associated with the suit (spade, heart, etc.) of a card, in addition to the number of the card. The numbers of the code elements may be associated with other information.

Further, the ultraviolet-ray reaction code may have plural rows of the code elements. The plural rows of code elements may be stacked inwardly from an edge of the card. A card may be specified by a combination of the numbers of the plural rows of code elements. In this case, a card is specified from the plural rows of code elements including given numbers. Accordingly, even in this case, the code elements including given numbers are read. Also, the number specifying unit specifies the number of a card associated with the numbers of the code elements.

Since the black light sensors are provided, the code elements are detected by the black light sensors, and a card is specified from the numbers of the code elements, the card can be detected with high precision.

A card shooter apparatus has a card reading function to read the number of a card. This card shooter apparatus includes black light sensors that read an ultraviolet-ray reaction code including the number of each of cards that are pulled one by one from a card shooter, from the card. In this aspect, the card shooter and the card reader may be provided separately or integrally. Even in this aspect, an advantage that reading precision can be improved is obtained, and an advantage that the threshold value of the card speed at the time of reading is raised is obtained.

The card shooter apparatus may further include a housing, a card shooter unit that is provided in the housing, and a card guide unit that is provided in the housing to guide cards pulled out one by one from the card shooter unit onto a game table. Here, the black light sensors are provided in the housing. The black light sensors may be provided in the housing. The housing may include a processing unit that processes the read data of the black light sensors, and a display unit that displays a processing result of the processing unit.

Hereinafter, embodiments of the invention will be described with reference to the drawings.

FIG. 1 shows a card reader 10 of the present embodiment. The card reader 10 includes a platform 12, a control box 14 is connected to the platform 12, and a monitor 16, and a win/lose display box 18 are connected to the control box 14. The control box 14 is a computer apparatus that controls the whole apparatus.

Figure 2:
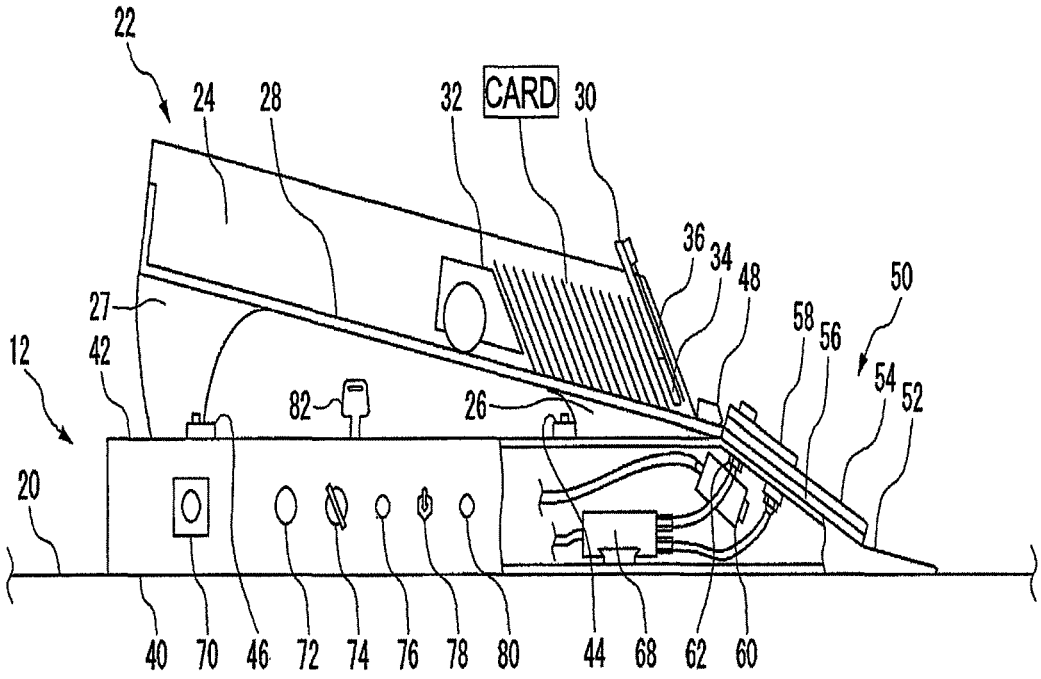
FIG. 2 is a view showing a platform along with a game table and a card shooter.

Referring to FIG. 2, the platform 12 is set on a game table 20, and a card shooter 22 (card shoe) is mounted on the platform 12.

Figure 3:
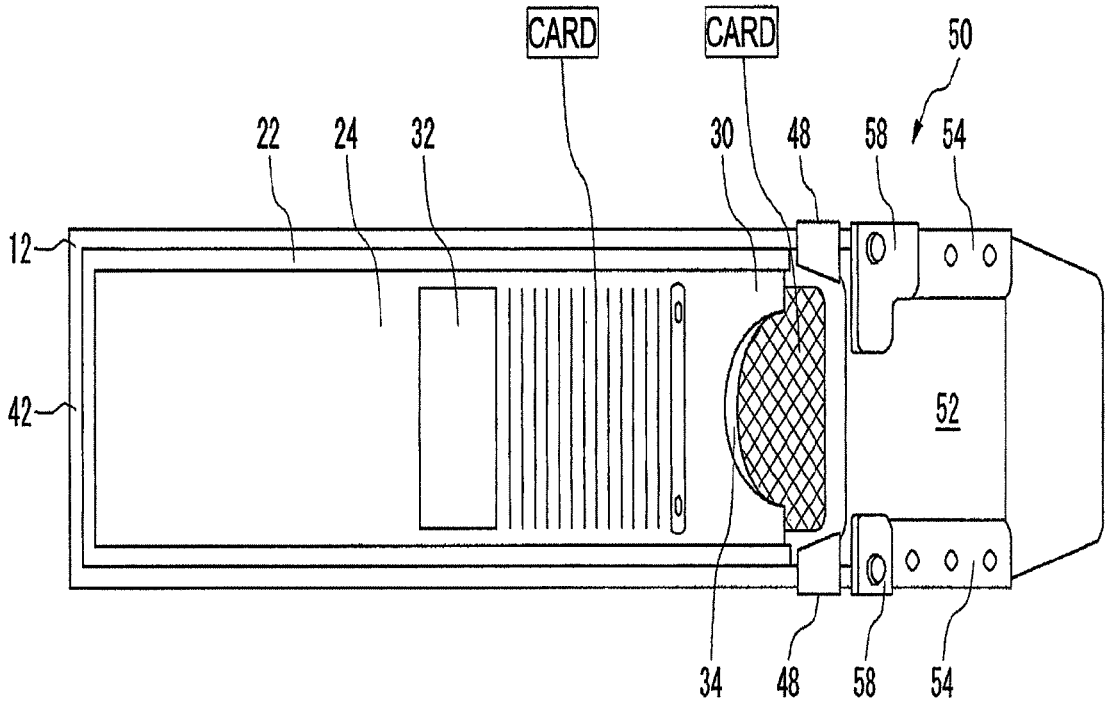
FIG. 3 is a plan view of the platform and the card shooter.

The card shooter 22 may be a general type of existing shooter. The card shooter 22 includes a card housing 24, and a fore leg 26 and a hind leg 27 under the card housing. A floor 28 and a front wall 30 of the card housing 24 incline as shown. Within the card housing 24, a deck of cards is forward pushed against the front wall 30 by a card push member 32 with a roller. The front wall 30, as shown in FIG. 3, has a U-shaped opening 34 in a lower part. A dealer slides the cards to take them out of the opening 34.

In addition, black cloth 36 (omitted in the other drawings) is hung on the front wall 30 so as to block the opening 34. Further, though not shown, a cover is attached to an upper part of the card housing 24. The card shooter 22 is black as a whole, and is made of resin.

Next, the configuration of the platform 12 will be described. The platform 12 is black and is made of resin, similarly to the card shooter 22. The platform 12 has a thin box shape as a whole. The platform 12 has a table mounting surface 40 at the bottom thereof, and a shooter setting surface 42 at the top thereof, and both the surfaces are flat.

The shooter setting surface 42 is provided with shooter positioning blocks 44 and 46. The card shooter 22 is put on the shooter setting surface 42 so that the fore leg 26 and the hind leg 27 of the card shooter 22 may contact the shooter positioning blocks 44 and 46, and thereby, the card shooter 22 is positioned with respect to the platform 12.

Further, shooter hold-down blocks 48 are attached to a front end of the shooter setting surface 42. The shooter hold-down blocks 48 holds down the front end of the card shooter 22 from upside, and thereby, the card shooter 22 is held on the platform 12.

The platform 12 has a card guide unit 50 in a front part thereof. The card guide unit 50 guides cards, which are pulled out one by one from the card shooter 22, onto the game table 20, as described below.

As shown in FIGS. 2 and 3, the card guide unit 50 has a card guide surface 52 that is an inclined plane. One end of the card guide surface 52 is connected with an opening 34 of a card outlet of the platform 12. The card guide surface 52 extends forward and downward from the front the card outlet, and the other end of the card guide surface is connected with the game table 20. The card guide surface 52 becomes a measurement surface for card reading.

Card guide rails 54 are attached to edges on both sides of the card guide surface 52. As shown in FIG. 2, a card passage gap 56 is formed between the card guide rails 54 and the card guide surface 52. The size of the card passage gap 56 is set to be slightly larger than the thickness of a card. After a card is pulled out of the card shooter 22, it passes along the card guide surface 52. At this time, both ends of the card pass through the card passage gap 56.

Further, the inclination of the card guide surface 50 is changed on the way as shown. The card guide rails 54 are provided in a region before the inclination changes, and the card guide rails 54 is slightly longer than the short sides of a card.

Figure 4:
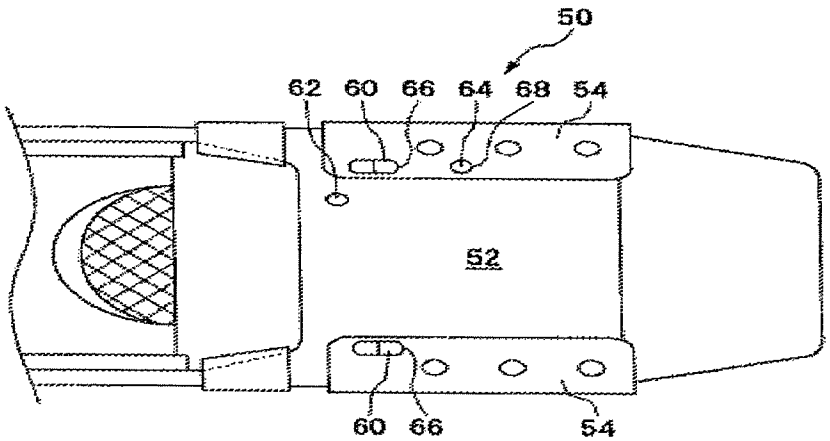
FIG. 4 is a plan view in a state where a sensor cover is detached.

Further, a sensor cover 58 is attached to each of the two card guide rails 54 with screws. As shown in FIG. 4, when the sensor covers 58 are detached, four sensors are exposed. The sensor covers 58 protect the sensors form outside light. The four sensors are two black light sensors 60, an object detecting sensor 62, and a measurement validity determining sensor 64, and these sensors are provided in the card guide surface 52 of the card guide unit 50. In the drawing, the black light sensors 60 and the measurement validity determining sensor 64 can be seen from sensor cleaning holes 66 and 67 that pass through the card guide rails 54.

Figure 5:
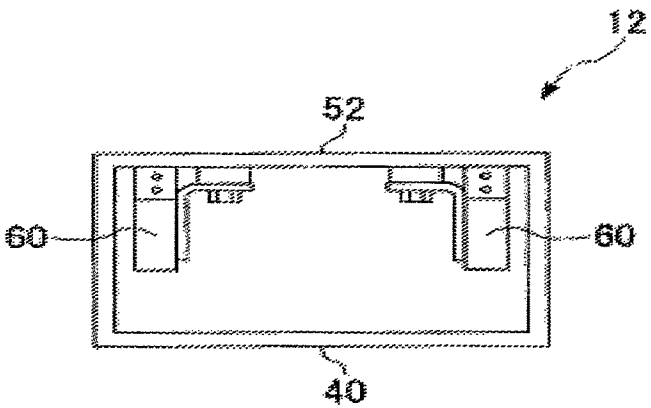
FIG. 5 is a sectional view of the platform.

As shown in FIG. 4, the black light sensors 60 (hereinafter referred to as UV sensors 60) are located on the relatively upstream side in the direction of flow of a card, on the card guide surface 52. Further, as shown in FIGS. 2 and 5, the UV sensors 60 are arranged in the inner space of the platform 12, are fixed to the ceiling (the other side of the card guide surface 52) of the platform with stays, and are exposed through the opening of the card guide surface 52.

Each of the UV sensors 60 includes an LED (ultraviolet LED) that emits ultraviolet rays, and a detector. A card is irradiated with ultraviolet rays (black light), and a code of the card is detected by the detectors. The code of the number (rank: A, 1 to 10, J, Q, and K) of a card is printed on the card with ultraviolet ray emission ink that produces a color when ultraviolet rays strike the card.

The above UV sensors 60 are connected to the control box 14 through cables. In the control box 14, the number of a card is determined from output signals of the detectors of the UV sensors 60.

Figure 13:
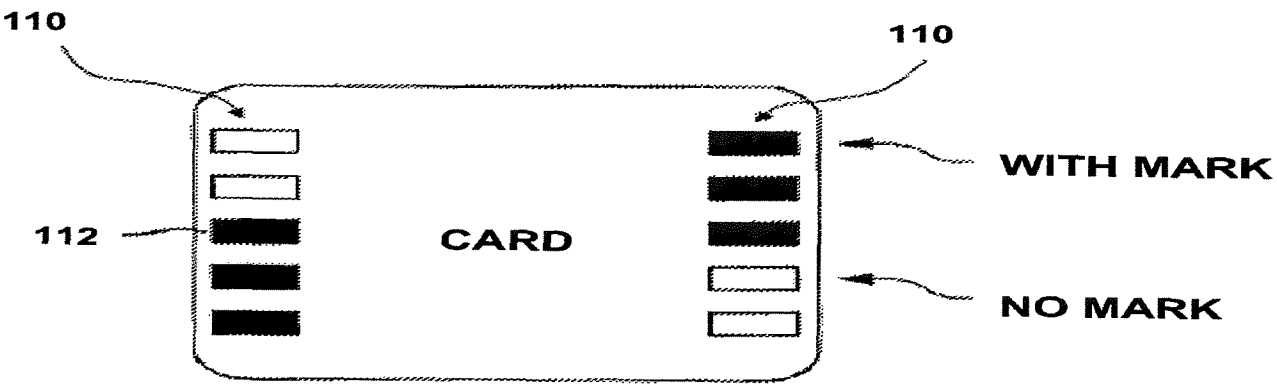
FIG. 13 is a view showing an example of a card.
Figure 15:
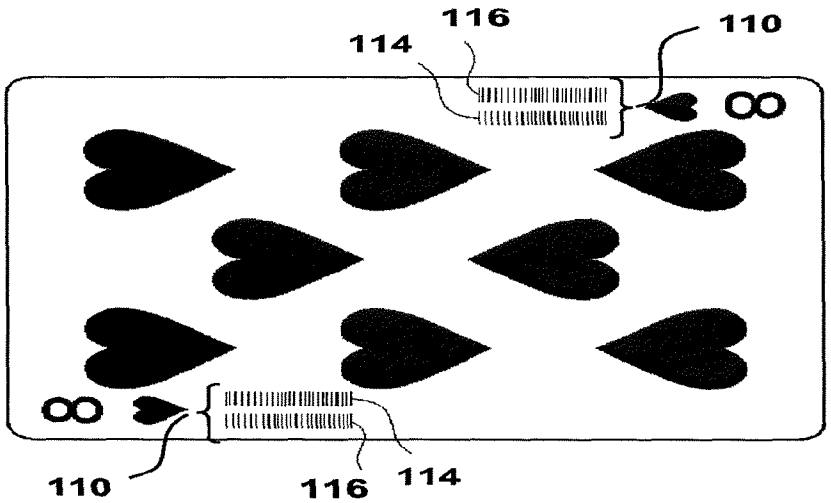
FIG. 15 is a view showing an example of a card.
Figure 16:
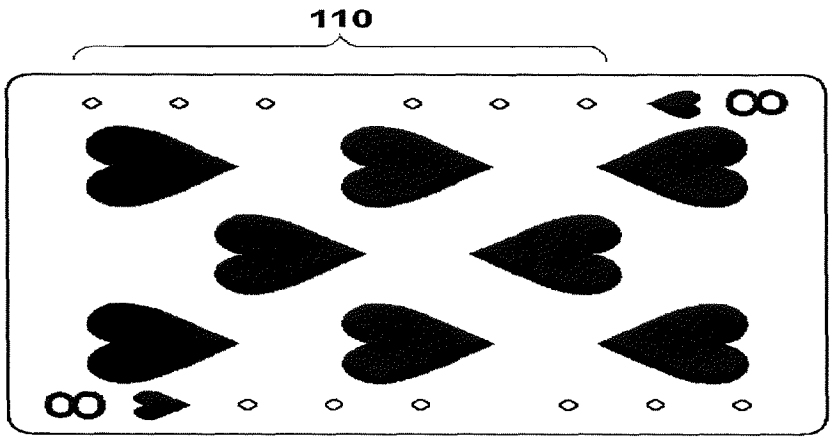
FIG. 16 is a view showing an example of a card.

Here, as the code 110 for the number of a card, for example, a plurality of code elements 112 are arrayed on edges of the card such as shown in FIGS. 13, 15, and 16. For example, the code elements 112 may be quadrangular marks, circular marks, or the like which are printed in ultraviolet ray emission ink.

The number of the card is expressed by the numbers of the marks. The UV sensors 60 output ON signals when the marks are detected. Accordingly, the UV sensors 60 on both edges output ON signals of the numbers of the marks. In the control box 14, the ON signals input from the two UV sensors 60 are counted. Thereby, the two mark numbers detected by the two UV sensors 60 are obtained. Also, the control box 14 specifies the number of a card from the numbers of the marks.

In addition, although the numbers of marks and the number of a card may be the same as each other, they may not be the same as each other. The numbers of the marks and the number of a card only need to match each other one-on-one. In the control box 14, a detected mark number is compared with a mark number that is registered in advance, and thereby, the number of a card may be specified.

Further, in the baccarat game, "J", "Q", and "K" are treated as equal to "10." Thus, the same code as "10" may be attached to "J", "Q", and "K." Further, in addition to the number of a card, a code representing a suit (spades, hearts, diamonds, and clubs) may be attached to a card, and this may be read. In this way, the type of codes is not limited if the numbers of cards required for a game are expressed.

As described above, in the present embodiment, the card reader 10 includes the UV sensors 60 that detects marks from a card and outputs signals. The above UV sensors 60 output ON signals during passage of marks. Marks including a given number are provided on a card, and the marks are provided on the edges of the card, and thereby arrayed in a card pulling direction so that they may pass through the UV sensors 60. Then, the number of the marks is associated with the number of the card, and the control box 14 specifies the card from detection signals of the UV sensors 60.

Further, as described above, in the card reader 10 of the present embodiment, the two UV sensors 60 are provided as shown in FIGS. 4 and 5. Then, as shown in the example of FIG. 13, marks are arrayed on both edges of a card in correspondence with both the UV sensors 60, and the marks are read by both the UV sensors 60. The marks are suitably provided in a region where a picture is not provided as shown. However, actual marks are not usually visible.

As described above, in the present embodiment, marks including a given number are suitably arrayed on each edge of a card. As for the association between a mark number and a card, the sum of mark numbers may simply be associated with the number of a card. Further, a combination of two rows of mark numbers may be associated with the number of a card. In the latter form, it is possible to identify more cards by few marks. Moreover, one of the rows may be associated with a number of the card and the other row may be associated with a suit of the card. In addition, FIG. 13 is just illustrative, and the number of mark rows is not limited to two, but the number of rows may be one or three or more.

Also, two mark rows 114 and 116 may be suitably provided on each of both edges of a card as shown in FIG. 15. In this case, the arrangement of the UV sensors is also properly adjusted.

Further, additionally describing the configuration of the control box 14, the control box 14 of the card reader 10 includes a counter, a memory (storage means), and a number specifying unit. The counter counts detection signals from the UV sensors 60, and finds out a mark number. Also, the memory stores information that associates the mark number with a card. The associated information is typically a table. The number specifying unit specifies the number of a card from the numbers of marks with reference to the information of the memory.

In the present embodiment, the counter is able to find out two mark numbers corresponding to the two UV sensors 60. As described above, in the present embodiment, a combination of a plurality of rows of mark numbers may be associated with a card. In this case, a memory stores information that associates the combination of the mark numbers with a card. Also, the number specifying unit specifies a card corresponding to the combination of the card numbers.

Figure 6:
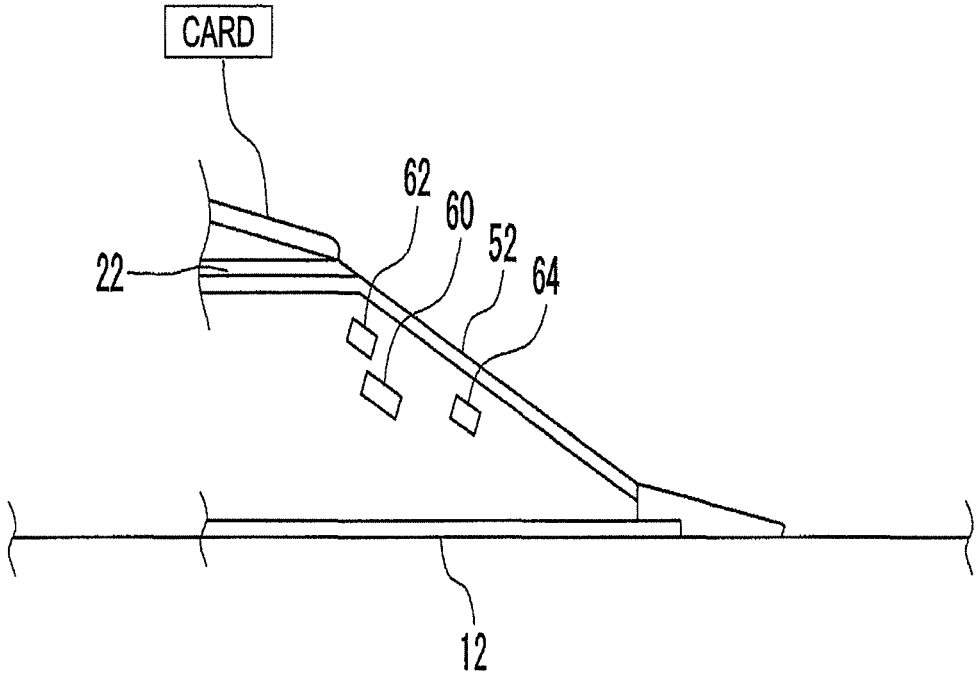
FIG. 6 is a view showing a sensor arrangement.

Next, the object detecting sensor 62 and the measurement validity determining sensor 64 are fiber sensors that detect the existence or non-existence of a card. The object detecting sensor 62 is located on the most upstream side along the flow direction of a card on the card guide surface 52, and the measurement validity determining sensor 64 is located on the downstream side of the object detecting sensor 62. Also, as shown in FIG. 6, the object detecting sensor 62 and the measurement validity determining sensor 64 are provided on the upstream and downstream sides of reading points of the UV sensors 60. The object detecting sensor 62 and the measurement validity determining sensor 64 correspond to a first card detecting sensor and a second card detecting sensor, respectively.

Further, similarly to the UV sensors 60, the object detecting sensor 62 and the measurement validity determining sensor 64 are arranged in the inner surface of the platform 12, are fixed to the ceiling of the platform, and are exposed through the opening of the card guide surface 52.

The object detecting sensor 62 and the measurement validity determining sensor 64, as shown in FIG. 2, are connected to the control box 14 by cables via a sensor amplifier 68. The sensor amplifier 68 is of a two channel type, and is able to independently control the object detecting sensor 62 and the measurement validity determining sensor 64. On the basis of detection signals of the object detecting sensor 62 and the measurement validity determining sensor 64, the control box 14, as will be described below, controls the start and end of reading of the UV sensors 60, and determines whether or not a card has normally passed along the card guide surface 52.

Figure 7:
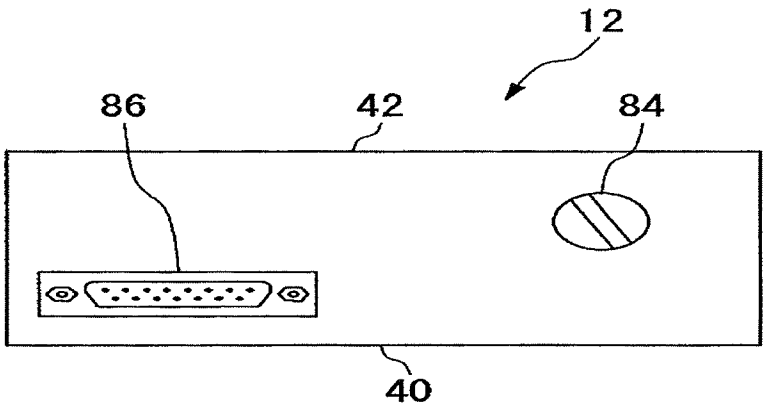
FIG. 7 is a view showing the back surface of the platform.

Further, as shown in FIG. 2, a side surface of the platform 12 is further provided with a buzzer 70, a push button 72 with a lamp, a reset switch 74, an error lamp 76 (red), a monitor changeover switch 78, and a normal lamp 80 (green). In the push button 72 with a lamp, the lamp is turned on or turned off whenever the button is pushed. The reset switch 74 is a switch of a type in which a key inserted into a keyhole is turned, and the monitor changeover switch 78 is a lever switch. Further, the upper surface of the platform 12 is provided with a standard/special mode changeover switch 82. This switch 82 is also a switch of a type in which a key inserted into a keyhole is turned. Further, as shown in FIG. 7, the back surface of the platform 12 is provided with a power switch 84 and a cable connector 86. The above various switches, lamps, buzzer, etc. are connected to the control box 14 through cables, and are used for various kinds of processing of the control box 14.

The configuration of the platform 12 has been described hitherto. As shown in FIG. 1, the card reader 10 is further provided with the monitor 16 and the win/lose display box 18.

The monitor 16 is controlled by the control box 14 to display the information on reading of a card, and a game. The win/lose display box 18 is provided with three lamps, i.e., a player-win lamp 90 (red), a draw lamp 92 (yellow), and a banker-win lamp 94 (green). These lamps are controlled by the control box 14, and they are turned on or off in order to display the win or lose of a game. As shown in this description, the card reader 10 of the present embodiment is applied to a baccarat game.

Further, the monitor 16 and the win/lose display box 18 are set in a proper location on the game table 20. On the other hand, the control box 14 is arranged in a proper location, such as the underside of the game table 20.

Figure 8:
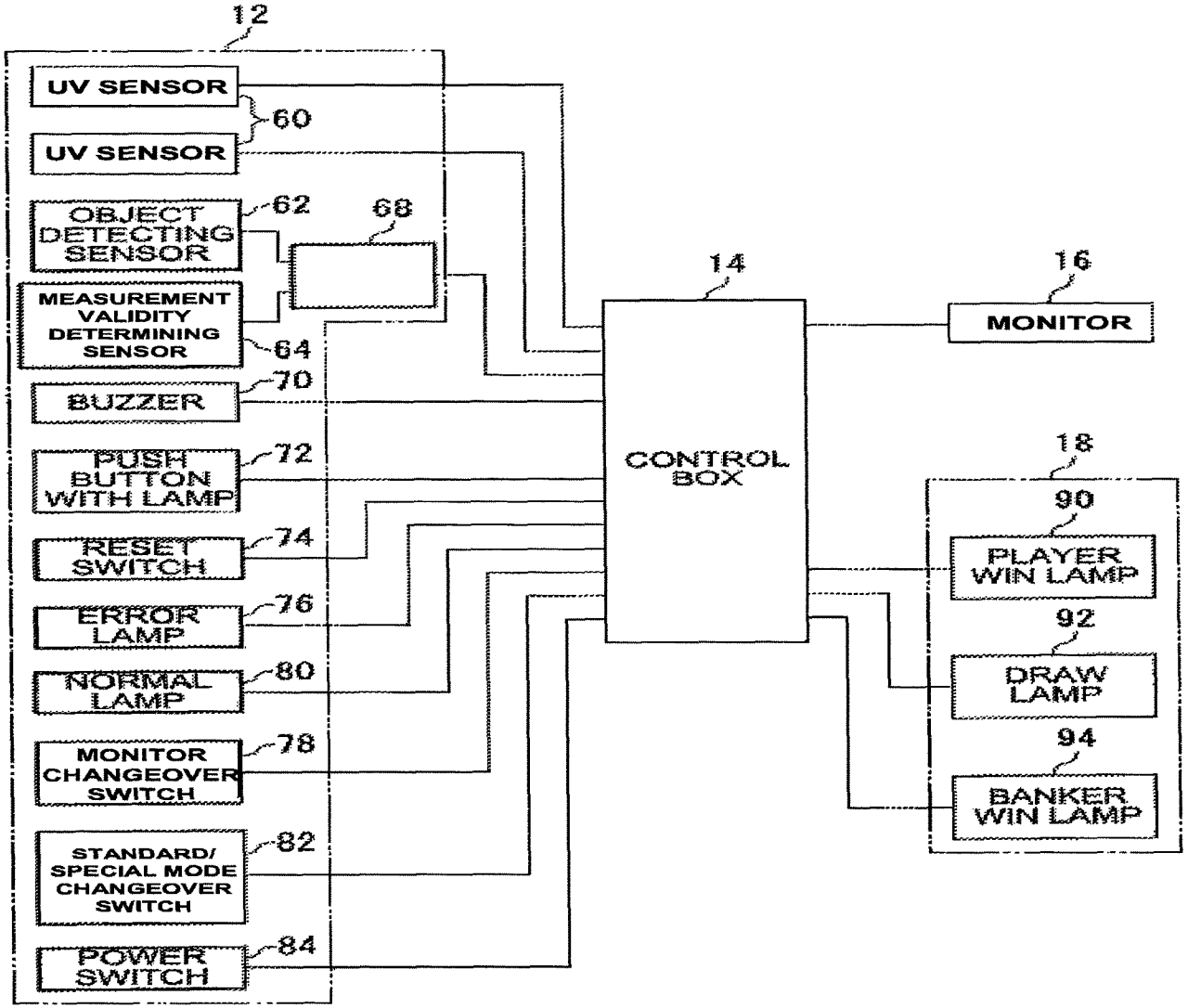
FIG. 8 is a block diagram showing a control configuration including a control box.

FIG. 8 is a functional block diagram of various components relevant to the control box 14. The control box 14 is a computer apparatus as earlier mentioned. The control box 14 is connected to the UV sensors 60, object detecting sensor 62, and measurement validity determining sensor 64 of the platform 12. Moreover, the control box 14 is connected to the various switches and lamps of the platform 12 to control them. Further, the control box 14 is connected to the monitor 16 and three lamps of the win/lose display box 18 to controls the display of them.

A computer serving as the control box 14 has a processing function to automatically determine win or lose of a game. This function is realized by incorporating a program for win/lose determination into the computer, and this program is executed by a processor of the computer.

As determination processing, the computer acquires the numbers of cards, which are sequentially taken out of the card shooter 22 to the game table 20, using the UV sensors 60. The acquired numbers of the cards are sequentially stored in the memory. At this time, the information on to which player each card has been distributed is also stored. That is, the numbers of cards are stored in association with distribution destinations.

From this point, the card reader 10 of the present embodiment is used in a baccarat game as earlier mentioned. In the baccarat game, two persons including a player and a banker exist (here, both are called players). Also, to which player the next card is to be distributed is uniquely determined from the number of cards distributed by then, and the number of each of the cards. The computer determines to which player a card read by the UV sensors 60 is to be distributed with reference to the numbers of the cards stored in the memory. Also, the number of the distributed card is stored in the memory in association with each player.

Moreover, the computer reads the numbers of the cards, which have been distributed to both players, from the memory, compares the numbers of the both players, and determines a win or lose. The numbers of the cards are summed, both sums are compared, and which player has won is determined. A draw is also determined.

As such, concerning the baccarat game, win or lose can be automatically determined only from the numbers of the cards sequentially taken out of the card reader 10. To which player a card has been distributed may not be detected using other sensors, for example, sensors separately embedded in the table.

The control box 14 causes a game result to be output to the monitor 16 and the win/lose display box 18. Read numbers, a game result, etc. are displayed on the monitor 16. Further, in the win/lose display box 18, a banker-win lamp 90, a draw lamp 92, or a player-win lamp 94 are turned on according to the game result.

Next, the functions of the object detecting sensor 62 and measurement validity determining sensor 64 will be described. As already described, the object detecting sensor 62 and the measurement validity determining sensor 64 detect the existence or non-existence of a card, and output detection signals to the control box 14. In the present embodiment, if a card exists, a signal is turned on, and if a card disappears, a signal is turned off.

First, the detection signal of the object detecting sensor 62 is used to control the start and end of reading of the UV sensors 60. That is, when the object detecting sensor 62 detects a card (from OFF to ON), the control box 14 instructs the UV sensors 60 to start reading. In the UV sensors 60, an LED is turned on, and a detector reads code. When the object detecting sensor 62 stops detecting a card (from ON to OFF, the control box 14 instructs the UV sensors 60 to end reading. In the UV sensors 60, an LED is turned off.

The object detecting sensor 62 and the measurement validity sensor 64 are used to judge an attitude of the card. This judgment is made in order to judge whether the card is sliding with a side of the card being in contact with the card guide rails 54 or not. It is judged that the card passed through in an appropriate attitude when: (1) the object detecting sensor 62 and the measurement validity sensor 64 detect the card in order; (2) these sensors detect that the card passed through (the card became nonexistent) in order; and (3) the object detecting sensor 62 and the measurement validity sensor 64 detect the card at the same time. In other cases, it is judged that the card did not pass through in an appropriate attitude. This judgment process is performed by the computer of the control box 14. The result of the judgment of a card attitude may be indicated, for example by turning on or off a lamp to indicate that the attitude was appropriate or not.

Algorithms for the attitude judgment are not limited to the above. For example, it may be judged that an attitude is appropriate even if not all the above conditions are met. However, using the above conditions allows the attitude judgment to be more correct.

The object detecting sensor 62 and the measurement validity determining sensor 64 are further used to determine whether or not a card has normally passed along the card guide surface 52.

Figure 9:
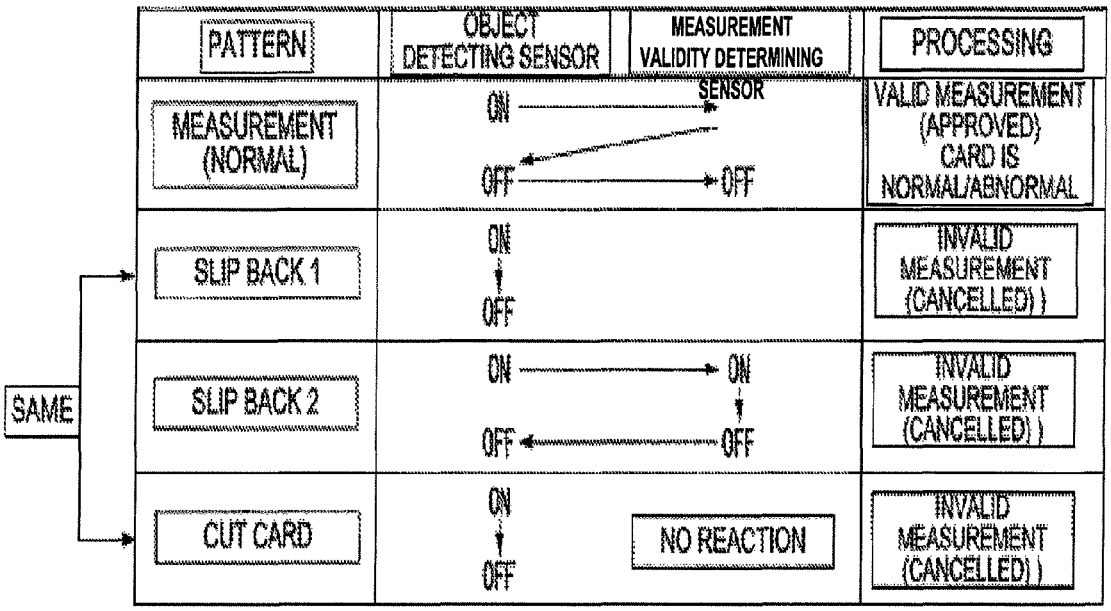
FIG. 9 is a view showing sensor output according to situations.

The first step of FIG. 9 shows a sensor output when (when a card has normally passed along the card guide surface) measurement is normal. In this case, a signal is turned on in order of the object detecting sensor 62 and the measurement validity determining sensor 64, and then, the signal is turned off in order of the object detecting sensor 62 and the measurement validity determining sensor 64. The reading result (measurement result) of the UV sensors 60 is valid (reading is approved).

However, if passage of a card is normal, but a mark number read by the UV sensors 60 read is abnormal, the control box 14 determines that the card itself is abnormal. For example, a card is abnormal when there is no mark at both edges of the card. The numbers of marks may be registered, and be compared with a detected mark number.

The second step of FIG. 9 shows a sensor output when a card slightly comes out onto a card guide, and slips back. The object detecting sensor 62 is turned on, and then, the object detecting sensor 62 is turned off. Since a card has not reached the measurement validity determining sensor 64, the measurement validity determining sensor 64 is not turned on. In this case, the reading result of the UV sensors 60 is invalidated.

The third step of FIG. 9 shows a sensor output when a card slips back after the card has reached the measurement validity determining sensor 64. A signal is turned on in order of the object detecting sensor 62 and the measurement validity determining sensor 64, and then, the signal is turned off in order of the measurement validity determining sensor 64 and the object detecting sensor 62. Even in this case, the reading result of the UV sensors 60 is invalidated.

The fourth step of FIG. 9 shows a sensor output when a cut card is taken out. Here, the cut card is a card used in a casino, etc., and is inserted into a deck of cards. Cards following the cut card are not used for a game. If this cut card is not disregarded, a read error is generated. Then, in order to disregard the cut card, the present embodiment is configured as follows.

Blue is given to the cut card. The sensitivity of the object detecting sensor 62 is adjusted so as to detect white and a mark color (a color when ultraviolet-ray reaction ink produces a color) as well as a blue object. On the other hand, the sensitivity of the object detecting sensor 64 is adjusted so as not to detect a blue object but to detect a white object and an object with a mark color. This is realized by lowering the sensitivity of the measurement validity determining sensor 64.

Since such sensitivity setting has been performed, when a cut card passes by as shown in the fourth step of FIG. 9, the object detecting sensor 62 is turned on, and then turned off. The measurement validity determining sensor 64 does not react. Accordingly, the same sensor output as the second step of FIG. 9 is obtained, and accordingly, reading of the UV sensors 60 is invalidated. In this way, passage of a cut card can be suitably disregarded.

In addition, although a cut card is blue in the above example, the invention is not limited thereto. A separate color may be given as long as it can adjust sensor sensitivity so that only a cut card may not be detected.

Figure 10:
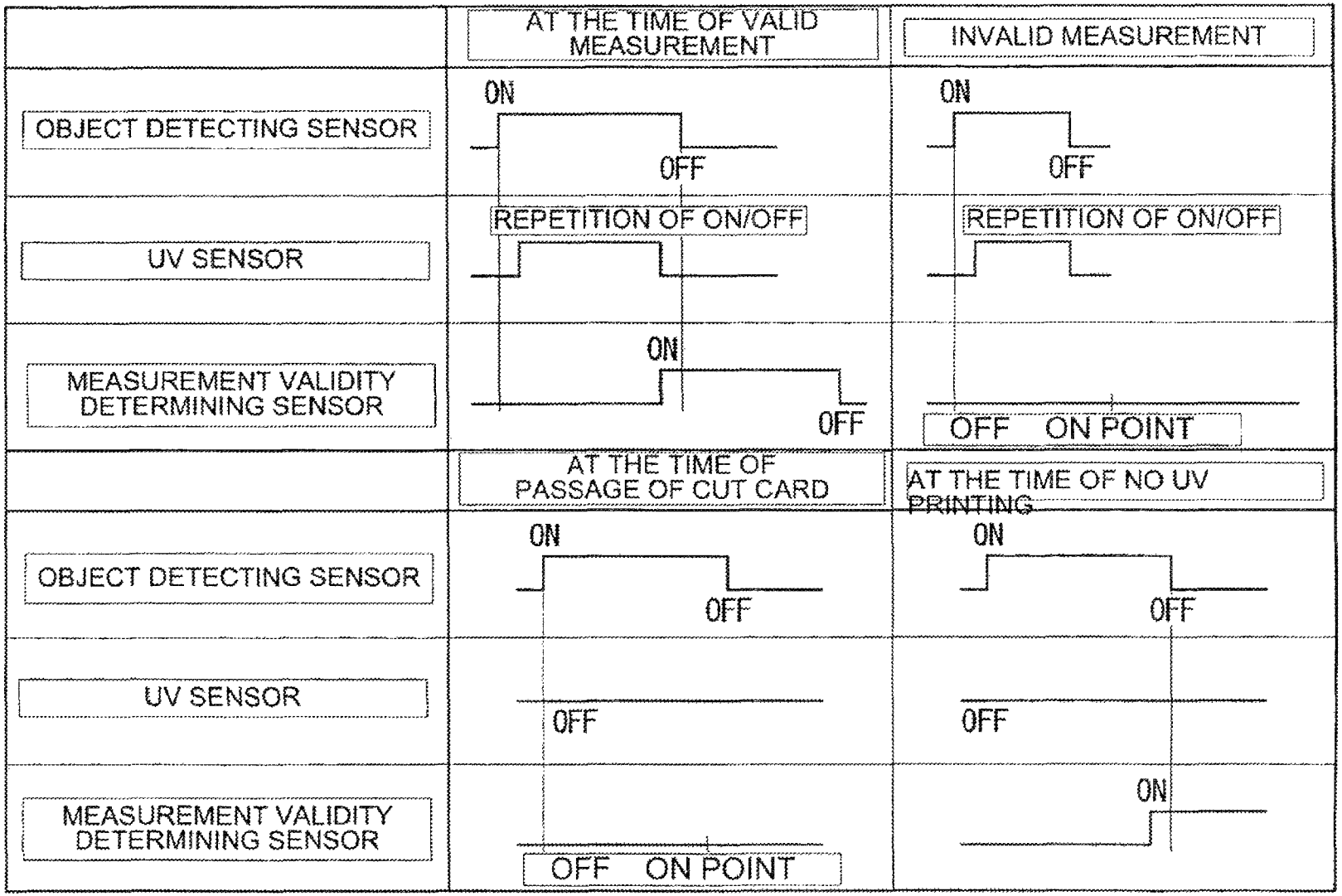
FIG. 10 is a view showing an example of the output waves of sensors.

FIG. 10 shows examples of the above-mentioned sensor output waves. When measurement is valid, the object detecting sensor 62 and the measurement validity determining sensor 64 are normally turned on and off as described above. Also, the UV sensors 60 are turned on and off during the measurement (during "ON" of the object detecting sensor 62), and the number of a card is found out from ON/OFF signals of the UV sensors 60.

Since the card slips back in the following pattern, the object detecting sensor 62 is turned off before the measurement validity determining sensor 64 is turned on. Therefore, the reading result of the UV sensors 60 during the measurement is invalidated.

Since the cut card has passed along the card guide surface in the following pattern, only the object detecting sensor 62 is turned on and off, similarly to the above pattern. The UV sensors 60 do not output any ON signal. Even in this case, the reading result is invalidated.

Since a card on which a code is not printed has passed along the card guide surface in the following pattern, the object detecting sensor 62 and the measurement validity determining sensor 64 are normally turned on and off, but the UV sensors 60 are kept turned off during the measurement. In this case, the control box 14 determines that an abnormal card has passed along the card guide surface.

The functions of sensors have been described hitherto in detail. Next, the operation of the card reader 10 of the present embodiment will be described.

Figure 11:
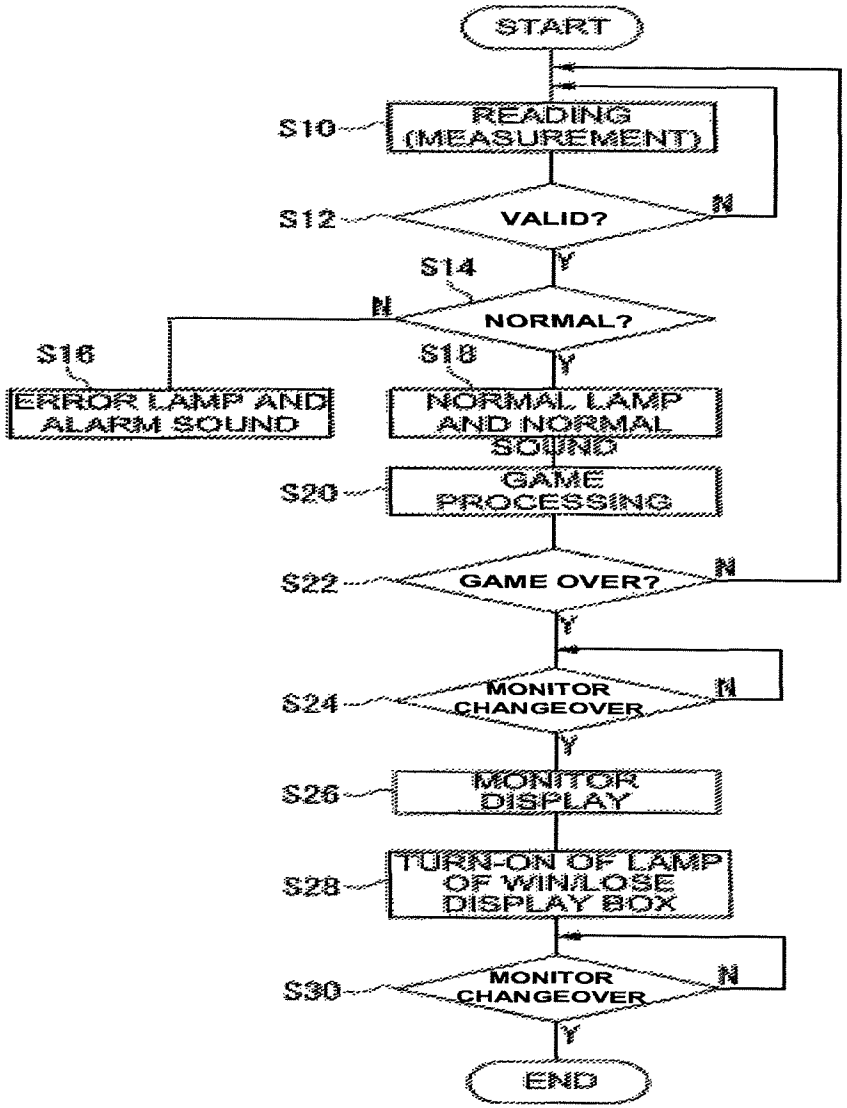
FIG. 11 is a flow chart showing the operation of the card reader when a normal mode is set.

FIG. 11 shows the operation of the card reader 10 when one game is performed. The power switch 84 is turned on as a precondition of the operation of FIG. 11. Further, the lever of the monitor changeover switch 78 is tilted to a position "before a game," and the "before a game" is displayed on the monitor 16. Moreover, the key of the reset switch 74 is turned to the left that is a normal position. Further, the standard/special mode setting switch 82 is turned to the standard side.

A first card is read in this state (S10). It is determined whether or not reading (measurement) has been valid (S12) on the basis of the output of the object detecting sensor 62 and the measurement validity determining sensor 64. If the answer is NO (invalid) in S12, the process returns to S10. For example, when a card has slipped back or a cut card has passed along the card guide surface, the process returns to S10 from S12.

If the answer is YES (valid) in S12, it is determined whether or not the code of the card is normal (S14). For example, if there is no code, the answer is set to NO in S14. In this case, the error lamp 76 is turned on, and an alarm sound is emitted from the buzzer 70 (S16). An alarm sound is, for example, a large volume of continuous sound. If a reset switch 74 is operated, the alarm sound will stop. The reset switch 74 is turned to the right from the left, and slips back to the left.

If the is YES (normal) in S14, the normal lamp 80 is turned on, and a sound indicating normality from the buzzer 70 is emitted (S18). For example, a short small sound is output.

Next, game processing is performed (S20). Here, as earlier mentioned, the read number of the card is stored for a player or a banker. Then, the number of the card that is stored in advance is compared, it is determined whether or not the game is ended, and the win or lose of the game is determined. If the game is not ended (S22, NO), the process returns to S10 where the next card is read. If the game is ended (S22, YES), the process will wait for the operation of the monitor changeover switch 78 (S24).

Also, if the lever of the monitor changeover switch 78 is tilted to a position "after a game" (S24, YES), the display of the monitor 16 is switched to "after a game," and a win or lose is displayed (S26). Further, even in the win/lose display box 18, a lamp corresponding to a game result is turned on (S28).

If the lever of the monitor changeover switch 78 is tilted to a position "before a game" (S30, YES), the display of the monitor 16 is changed to "before a game," and the processing is completed. Then, the process proceeds to the next game, and the processing of FIG. 11 is performed again.

Figure 12:
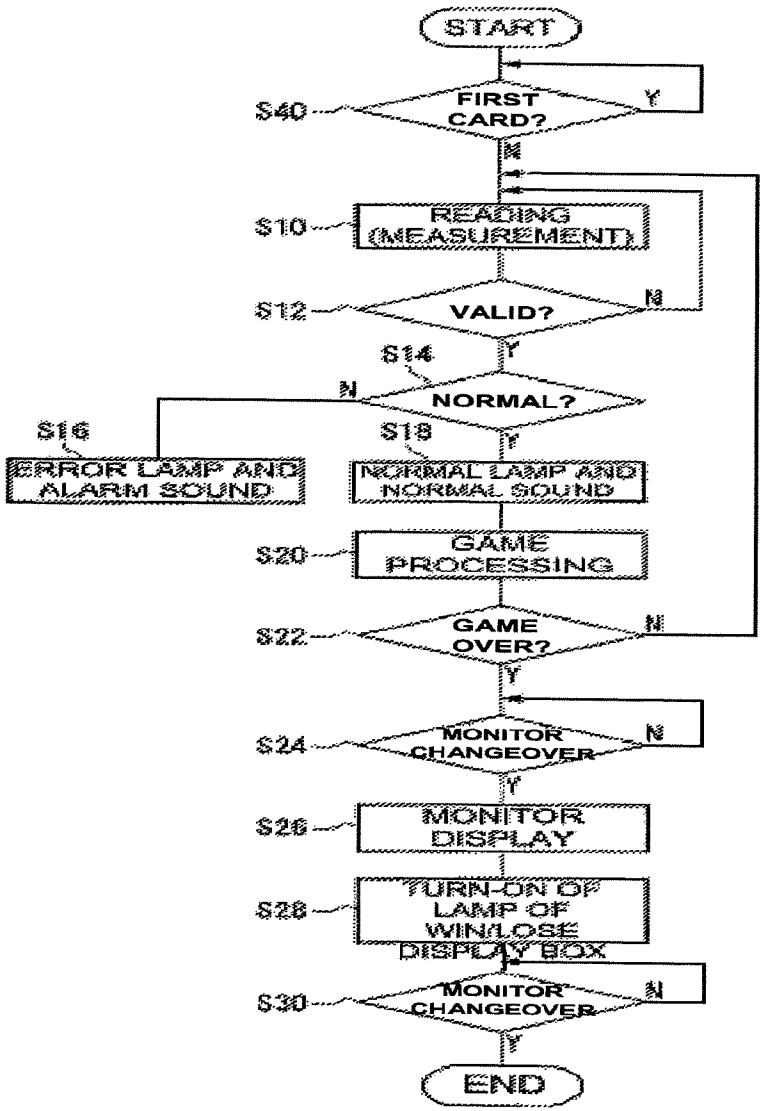
FIG. 12 is a flow chart showing the operation of the card reader when a special mode is set.

FIG. 12 shows the operation of the card reader 10 when a special mode is set. The special mode is set by the control box 14 when the standard/special mode changeover switch 82 is turned to "Special." The special mode is a first card invalid mode in which a card that is first pulled out in each game is invalidated.

FIG. 12 is different from FIG. 11 in that it is first determined whether or not any card is first just before S10 (S40). Here, for example, the object detecting sensor 62 and the measurement validity determining sensor 64 are turned on in this order, and turned off in this order. As a result, when a card has passed along the card guide surface, it is determined whether or not this card is first. If a card is first, the process does not proceed to S10 but returns to S40. If a card is not first, the process proceeds to S10. Accordingly, the second and succeeding cards are read.

Whether or not a card is first is determined, for example, using a flag. That is, when the flag is not raised in the processing of S40, it is determined that the card is first, and the flag is raised. Also, if the flag is raised, it will be determined that the card is not first. The flag is reset after the game is ended.

In addition, in the push button 72 with a lamp in the platform 12, a lamp is turned on or turned off whenever the button is pushed. When the button 72 is turned off, the card reader 10 reads a card as described above. On the other hand, when the button 72 is turned on, the card reader 10 does not read a card. The button 72 is used, for example, when reading of the card reader 10 is temporarily suppressed.

The preferred embodiment has been described hitherto. According to the present embodiment, the platform 12 is provided between the game table 20 and the card shooter 22, and the platform 12 is provided with a card reading function. Thus, reading of a card is enabled while the existing card shooter 22 is utilized. Moreover, since the black light sensors 60 are used, reading precision is high, and the threshold value of the card speed at the time of reading can also be set to a large value, for example, about 3.6 m/s. In this way, a card reader that is capable of utilizing an existing card shooter, is high in reading precision, and is high in the threshold value of the card speed at the time of reading can be provided. Also, the reading result of a card is suitably helpful to prevention of an illegal act.

Further, in the present embodiment, the card guide 50 has the card guide surface 52, the edge of the card guide surface 52 is provided with the card guide rails 54, and the card passage gap 56 is formed between the card guide surface 52 and the card guide rails 54. Also, the black light sensors 60 are provided so as to read a card from the card guide surface 52 within the card passage gap 56. Accordingly, the influence of outside light in a card reading part can be reduced, and reading precision can be improved.

Further, in the present embodiment, the computer of the control box 14 functions as a win/lose determining means, the win or lose of a card game is automatically determined on the basis of the numbers of cards that are sequentially read by the black light sensors, and the determined game result is output from the monitor 16 and the win/lose display box 18. Thus, an illegal act can be prevented while the progress of a game can be supported.

Further, in the present embodiment, the computer of the control box 14 functions as an invalid mode setting means, and a first card invalid mode can be set as described above. Accordingly, even when a rule that invalidates the first card is adopted, the card reader 10 can perform game result determination processing adapted to a card game, and can progress a card game smoothly.

Further, in the present embodiment, first and second card detecting sensors (the object detecting sensor 62 and the measurement validity determining sensor 64) are arranged along the guiding direction of the card guide unit 50, and the computer of the control box 14 functions as a measurement validity/invalidity determining means. Accordingly, the computer of the control box 14 can determine whether or not a card has normally passed along the card guide unit 50.

Further, in the present embodiment, the computer of the control box 14 suitably determines that a card normally passed along the card guide unit, when the first card detecting sensor and the second card detecting sensor detect the card in order, and then, the first card detecting sensor and the second card detecting sensor stop detecting a card in order.

Further, in the present embodiment, the computer of the control box 14 invalidates reading of a card, when the card is detected in order of the first card detecting sensor and the second card detecting sensor, and then, detecting a card is stopped in order of the first card detecting sensor and the second card detecting sensor. Accordingly, when a card slips back, it is possible to suitably cope with this.

Further, in the present embodiment, the sensitivity of a second card detecting sensor is set low so as to detect a card for a game and so as not to detect a cut card. Accordingly, when a cut card is used, it is possible to suitably cope with this.

Further, in the card reader 10 of the above-described present embodiment, the black light sensors (UV sensors) detect code elements including a given number from a card which the code elements are arrayed in a card pulling direction as an ultraviolet-ray reaction code, and outputs a detection signal. Also, the card reader 10 includes a number specifying means, and the number specifying means specifies a card associated with the numbers of the code elements on the basis of the detection signals of the black light sensors. In the above embodiment, the code elements are marks printed with ultraviolet-ray reaction ink. Further, the number specifying means is the computer of the control box.

Further, an ultraviolet-ray reaction code may have plural rows of the code elements like the above example. A card may be specified by a combination of the numbers of the plural rows of code elements. In this case, a card is specified from the plural rows of code elements including given numbers. Accordingly, even in this case, the code elements including given numbers are read. Also, the number specifying unit specifies the number of a card associated with the numbers of the code elements.

In the present embodiment, as described above, the numbers of the code elements are associated with at least the number of a card. The numbers of the code elements may be associated with the type (spade, heart, etc.) of a card, in addition to the number of the card. Moreover, the numbers of the code elements may be associated with other information.

According to the present embodiment, since the black light sensors are provided, the code elements are detected by the black light sensors, and a card is specified from the numbers of the code elements, the card can be detected with high precision.

Here, the advantages of the present embodiment will be described in more detail by contrast with a conventional technique.

The conventional technique uses a visible light camera. When the visible light camera is used, an existing conventional picture must be used for a card. The code elements like the present embodiment cannot be used for the following reason. That is, since only a photographic subject of visible light can be read when a camera is used, the code elements should also be printed with visible light ink. However, adding code elements onto a card separately from the conventional existing picture is not allowed in appearance. Accordingly, when the visible light camera is used, the code elements like the present embodiment cannot be used. On the other hand, the black light sensors are used in the present embodiment. Accordingly, the code elements just need to react to ultraviolet rays. That is, the code elements may not ordinarily be a photographic subject of visible light. As such, in the present embodiment, the black light sensors are provided so that the code elements can be utilized as objects to be read other than a conventional picture of a card.

Further, since the visible light camera is conventionally used, the conventional card picture must be used as described above. Therefore, the precision of reading is low, and the threshold value of the card speed at the time of reading is also low. On the other hand, in the present embodiment, the black light sensors detect code elements. Also, a card is specified from the numbers of the code elements. The code elements are, for example, marks. The numbers of the marks just needs to be counted, not the image processing of a picture. Such counting can be performed with high precision. Also, even if the card speed is increased, the counting of the mark numbers can be performed with high precision.

Further, the present embodiment is also different from a bar code reader. In the bar code reader, the thickness of a line is an object to be read. On the other hand, in the present embodiment, the thickness of a line is not detected, but marks are simply detected, and a card is specified from the numbers of the marks. Accordingly, even if the present embodiment is compared with the bar code reader, reading is precise, and the threshold value of the card speed at the time of reading increases.

As such, in the present embodiment, (1) black light sensors are provided, whereby objects to be read become code elements other than the conventional picture, and (2) unlike the conventional image processing of a picture, code elements are detected, and a card is specified from the numbers of the code elements. By virtue of these factors, precision of reading can be improved compared with the conventional technique, and the threshold value of the card speed at the time of reading can also be made high.

As an additional advantage, according to the present embodiment, code elements are suitably given to all the cards. Accordingly, it can be understood that, when any code elements are not detected, a card is abnormal. This is suitably helpful to prevention of an illegal act.

Further, as an additional advantage, according to the present embodiment, the black light sensors can be used to miniaturize an apparatus compared with a configuration provided with the conventional visible light camera.

Further, in the card reader 10 of the present embodiment, the platform 12, the control box 14, the monitor 16, and the win/lose display box 18 are separately provided. As a modified example, some or all of them may be integrated. For example, the control box 14 may be built in the platform 12.

Further, since the card reader 10 of the present embodiment can be used for checking of a card for illegal act prevention, etc., it can be called a card checking apparatus. Also, since the card reader is used along with a shoe (shooter), it can also be called a shoe-type checking apparatus. Also, reading of a code in the above embodiment can also be called measurement for checking. Accordingly, the UV sensors 60 may be called code reading sensors, and may be called measuring sensors.

In another modified example, the card reader 10 of the present embodiment is integrated with a card shooter. In this case, an advantage that an existing card shooter can be utilized is no longer obtained. However, an advantage that reading precision can be improved is obtained, and an advantage that the threshold value of the card speed at the time of reading is raised is obtained.

Figure 14:
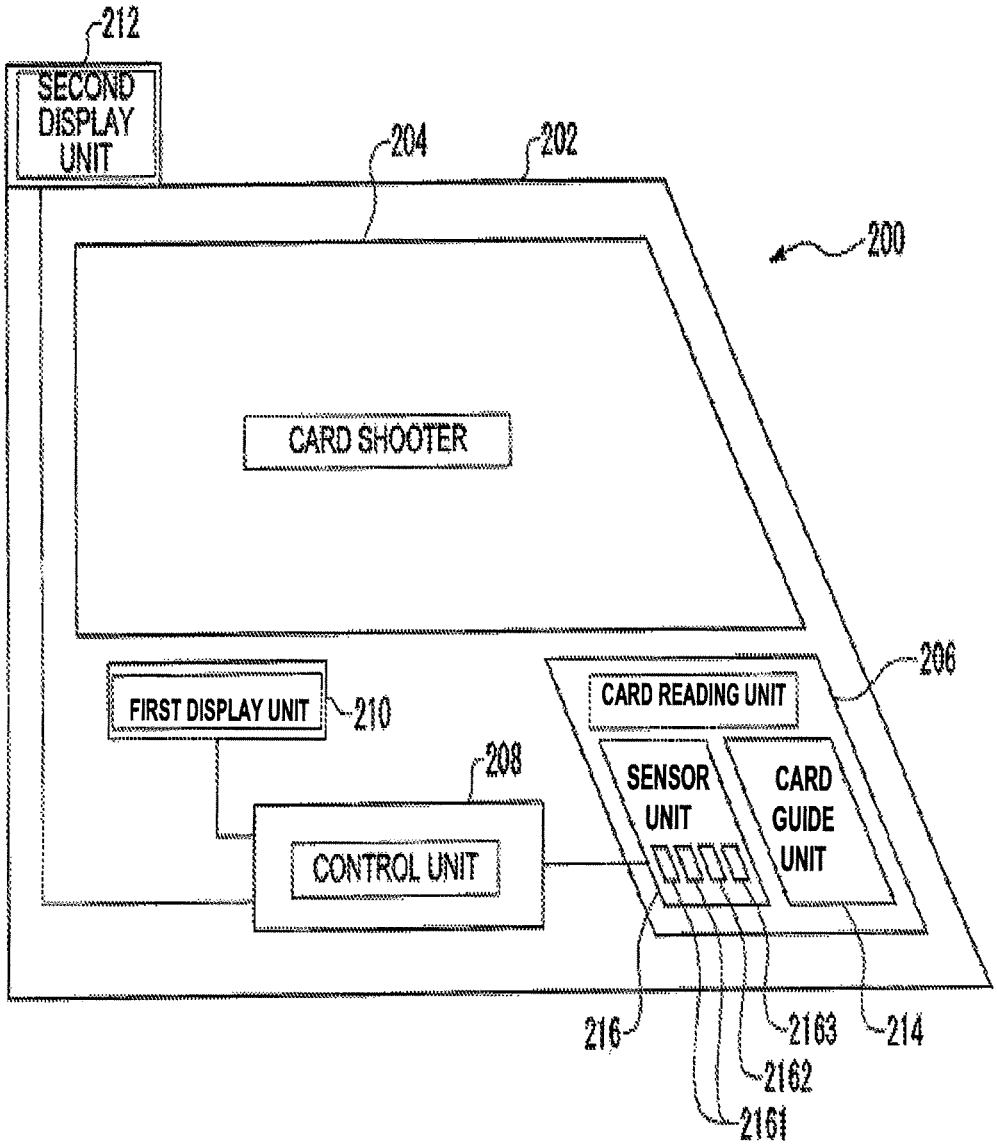
FIG. 14 is a view showing a configuration in which the card reader and the card shooter are integrated.

FIG. 14 shows an integrated configuration. A card shooter apparatus 200 includes a housing 202. The housing 202 corresponds to the configuration in which the housing of the shooter and the housing of the platform in the above-described embodiment are integrated together. The housing 202 is provided with a card shooter unit 204. The card shooter unit 204 includes various components of the above-described card shooter.

The housing 202 is further provided with a card reading unit 206, a control unit 208, a first display unit 210, and a second display unit 212. The card reading unit 206 is composed of a card guide unit 214 and a sensor unit 216.

The card guide unit 214 has the same function as the card guide unit in the above-described embodiment. In the above-described embodiment, the card guide unit is provided in the platform. In this configuration, the card guide unit 214 is provided in the housing 202. The card guide unit 214 may be connected with a card outlet of the card shooter unit 204, and may be integrated with the outlet.

The sensor unit 216 is composed of the sensors of the above-described embodiment. That is, the sensor unit 216 has a black light sensor 2161, an object detecting sensor 2161, a measurement validity determining sensor 2163, and related components. In the above-described embodiment, the sensors are built in the platform. In this configuration, the sensor unit 216 is built in the housing 202. Also, the sensor unit 216 is located in the place where the card guide unit 206 exists.

The control unit 208 is a control device corresponding to the control box of the above-described embodiment. In the above-described embodiment, the control box is arranged separately from the platform. In this configuration, the control unit 208 is built in the housing 202.

The first display unit 210 is the monitor of the above-described embodiment. The second display unit 212 corresponds to the three lamps of the win/lose display box in the above-described embodiment. In the above-described embodiment, the monitor and the lamps are disposed on the table apart from the platform. In this configuration, the monitor of the first display unit 210 is provided on a side surface of the housing 202. Further, the second display unit 212 is provided at a rear end of an upper surface of the housing 202.

Similarly to the above-described embodiment, in the card shooter apparatus 200, a card is read, read data is processed, and a processing result is displayed.

The preferred embodiment of the invention has been described hitherto. However, it is natural that the invention is not limited to the above-described embodiment, but persons skilled in the art can alter the above-described embodiment within the scope of the invention.

INDUSTRIAL APPLICABILITY

The invention can improve the reading precision of the code of a card, and is useful in prevention of an illegal act.

What is claimed is:

1. A table game system comprising:

a plurality of playing cards, each of the cards including an ultraviolet-ray reaction code comprising at least two separate sets of code elements arranged along one side of a face of the card, the same ultraviolet-ray reaction code being provided along an opposed side of the face of the card, the ultraviolet-ray reaction code representing at least a number of a card; and a card shooter apparatus comprising:

a card housing for containing the cards, a card guide unit that guides cards one by one from out of the card housing, one or more card detecting sensors arranged along a guiding direction of the card guide unit for detecting backward and forward movement of a card passed along the card guide unit, the card detecting sensors being configured to detect the backwards movement of a card when the card has been slipped back into the card shooter after the card is guided out of the card shooter, and one or more black light sensors that read the ultraviolet-ray reaction code from each card guided by the card guide unit.

2. The table game system according to claim 1, wherein the card shooter apparatus further comprises:

a measurement validity/invalidity determining means that performs an algorithm for determining whether or not the card has normally passed along the card guide unit on the basis of detection signals of the one or more card detecting sensors.

3. The game table system according to claim 1, wherein the card shooter apparatus further comprises:

a number specifying means for specifying the number of the card associated with the ultraviolet-ray reaction code on the basis of detection signals from the one or more black light sensors.

4. The table game system according to claim 1, wherein the card shooter apparatus further comprises:

a win/lose determining means for determining a result of a casino-style card game on the basis of the reading of the ultraviolet-ray reaction codes on the cards by the one or more black light sensors, wherein at least the black light sensors and the win/lose determining means are contained integrally within the card shooter apparatus.

5. The table game system according to claim 4, wherein the card shooter apparatus further comprises:

an output means for outputting the result determined by the win/lose determining means.

6. The table game system according to claim 5, wherein the output means includes one or more lamps that display the result determined by the win/lose determining means.

7. The table game system according to claim 5, wherein the output means includes a monitor that is provided on a housing of the shooter apparatus.

8. The table game system according to claim 1, wherein the card shooter apparatus further comprises:

a reading instruction means for controlling at least the start of reading of the ultraviolet-ray reaction code by the one or more black light sensors on the basis of a detection signal from the one or more card detecting sensors indicating whether a card has been detected.

9. The table game system according to claim 1, further comprising an attitude judgment means for determining whether the card passed through the card reading sensors in a proper attitude on the basis of detection signals of the one or more card detecting sensors.

10. The table game system according to claim 1, wherein the card guide unit comprises:

a card guide surface; and card guide rails provided at edges of the card guide surface;

wherein a card passage gap is formed between the card guide surface and the card guide rails.

11. The table game system according to claim 1, wherein the card shooter apparatus further comprises:

a cover that protects the one or more black light sensors from outside light.

12. The table game system according to claim 1, wherein the code elements are arrayed in the card guiding direction of the card guide unit.

13. The table game system according to claim 1, wherein the ultraviolet-ray reaction code is spaced from an edge of the card.

14. The table game system according to claim 1, wherein the sets of code elements are each arranged in rows, the rows being stacked inwardly in relation to one another from an edge of the card toward the center of the card.

15. The table game system according to claim 1, wherein each of the one or more black light sensors correspond to one of the sets of code elements.

16. The table game system according to claim 1, wherein the number of a card is specified from the arrangement of the code elements in the ultraviolet-ray reaction code.

17. The table game system according to claim 1, wherein the ultraviolet-ray reaction code is associated with at least the number and suit of the card.

18. A table game system comprising:

a plurality of playing cards, each of the cards including an invisible code provided along a side of the face of the card, the same invisible code provided along an opposed side of the face of the card, the invisible code representing at least a number of a card; and a card shooter apparatus comprising:

a card housing for containing the cards, a card guide unit that guides cards one by one from out of the card housing, one or more card detecting sensors arranged along a guiding direction of the card guide unit for detecting backward and forward movement of a card passed along the card guide unit, the card detecting sensors being configured to detect the backwards movement of a card when the card has been slipped back into the card shooter after the card is guided out of the card shooter, and one or more readers that read the invisible code from each card guided by the card guide unit.

19. The table game system according to claim 18, wherein the card shooter apparatus further comprises:

a win/lose determining means for determining a result of a casino-style card game on the basis of the reading of the invisible code on the cards by the one or more readers, wherein at least the one or more readers and the win/lose determining means are contained integrally within the card shooter apparatus.

* * * * *